US006158813A

United States Patent [19]

Karash

[11] Patent Number: 6,158,813

[45] Date of Patent: Dec. 12, 2000

[54] DISPOSABLE HEAD AND NECK REST

[76] Inventor: L. Stanley Karash, 722 North Baltimore, Hastings, Nebr. 68901

[21] Appl. No.: 09/075,301

[22] Filed: May 8, 1998

[51] Int. Cl.[7] ..... A47C 1/10

[52] U.S. Cl. ..... 297/391; 297/397

[58] Field of Search ..... 297/391, 397, 297/440.12, 423.41; 5/622, 640, 628, 924, 637; 248/152, 174, 459, 346.4, 247, 248; 128/845, 846, 869, 870, 876

[56] References Cited

U.S. PATENT DOCUMENTS

| | | | |
|---|---|---|---|
| D. 282,802 | 3/1986 | Righini | D6/596 |
| 1,937,643 | 12/1933 | Drewry | 229/52 |
| 3,604,026 | 9/1971 | Scheips | 5/337 |
| 3,955,252 | 5/1976 | Reda | 27/12 |
| 4,274,673 | 6/1981 | Kifferstein | 297/220 |
| 4,339,151 | 7/1982 | Riggs | 297/464 |
| 4,526,316 | 7/1985 | Sutherland | 229/40 |
| 4,773,707 | 9/1988 | Vadala | 297/391 |
| 5,146,641 | 9/1992 | Zwickey | 5/628 |
| 5,154,477 | 10/1992 | Lacy | 297/397 |
| 5,402,932 | 4/1995 | Fadaie | 229/195 |
| 5,579,551 | 12/1996 | Tommaney | 5/636 X |
| 5,639,019 | 6/1997 | Mayled | 229/195 |
| 5,944,016 | 8/1999 | Ferko, III | 128/869 |

FOREIGN PATENT DOCUMENTS

| | | | |
|---|---|---|---|
| 2274246 | 7/1994 | United Kingdom | 5/640 |

*Primary Examiner*—Lynne H. Browne
*Assistant Examiner*—John R. Cottingham
*Attorney, Agent, or Firm*—Lathrop & Gage, LC

[57] ABSTRACT

A foldable head and neck rest comprising a generally rectangular cardboard member which may be folded to create a pair of spaced-apart triangular-shaped support members on opposite sides of a base portion so that the base portion may be positioned behind the user's neck and/or head with the triangular-shaped supports being positioned on opposite sides of the user's neck and/or head.

6 Claims, 5 Drawing Sheets

DISPOSABLE HEAD AND NECK REST

BACKGROUND OF THE INVENTION

1. Field of the Invention

This invention relates to a head and neck rest and more particularly to an inexpensive head and neck rest which may be disposed of after use.

2. Description of the Related Art

Many types of head and neck rests have been provided for use during travelling. For example, one type of prior art head and neck rest is one which may be inflated to a horseshoe shape for positioning on either side of the person's neck or head. A second type of prior art head and neck rest is one in which a horseshoe-shaped member is filled with beans or the like. Further prior art head and neck rests are the U-shaped or horseshoe-shaped pillows. Although the prior art neck supports do perform their intended function, they are expensive and must be re-packed after use so that they may be re-used at a later time.

SUMMARY OF THE INVENTION

A disposable head and neck rest is provided which is formed from a generally rectangular member preferably comprised of a cardboard material with the rectangular member having a forward side, a rearward side, a top edge, a bottom edge, and first and second ends. The rectangular member has first, second, third and fourth fold lines formed therein. The first fold line extends between the top and bottom edges; of the rectangular member inwardly of the first end thereof to define a first flap portion. The second fold line extends between the top and bottom edges of the rectangular member inwardly of the first fold line to define a second flap portion. The third fold line extends between the top and bottom edges of the rectangular member inwardly of the second end thereof to define a third flap portion. The fourth fold line extends between the top and bottom edges of the rectangular member inwardly of the third fold line to define a fourth flap portion. The second and fourth fold lines define a base portion therebetween. The first and second flap portions are foldable along the first and second fold lines to form a first triangular-shaped support. The third and fourth flap portions are foldable along the third and fourth fold lines to form a second triangular-shaped portion. The first and second triangular-shaped supports are spaced apart to provide an area to receive the user's neck or head therebetween. In the preferred embodiment, the first and second triangular-shaped supports are maintained in position by means of tabs extending through the spaced-apart slots formed in the base portion. If desired, an elongated elastic member may be secured to the base portion and extended around the upper portion of a seat to maintain the head and neck rest in position.

It is therefore a principal object of the invention to provide an improved head and neck rest.

Yet another object of the invention is to provide a disposable head and neck rest.

Yet another object of the invention is to provide a head and neck rest which is constructed from an inexpensive paper material so that the head and neck rest may be thrown away after use.

Yet another object of the invention is to provide a head and neck rest which may be folded flat prior to use but which may be folded to a shape wherein first and second supports are provided at opposite ends of the head and neck rest.

Yet another object of the invention is to provide a disposable head and neck rest which is convenient to use.

These and other objects will be obvious to those skilled in the art.

DESCRIPTION OF THE PREFERRED EMBODIMENT

Figure 1:
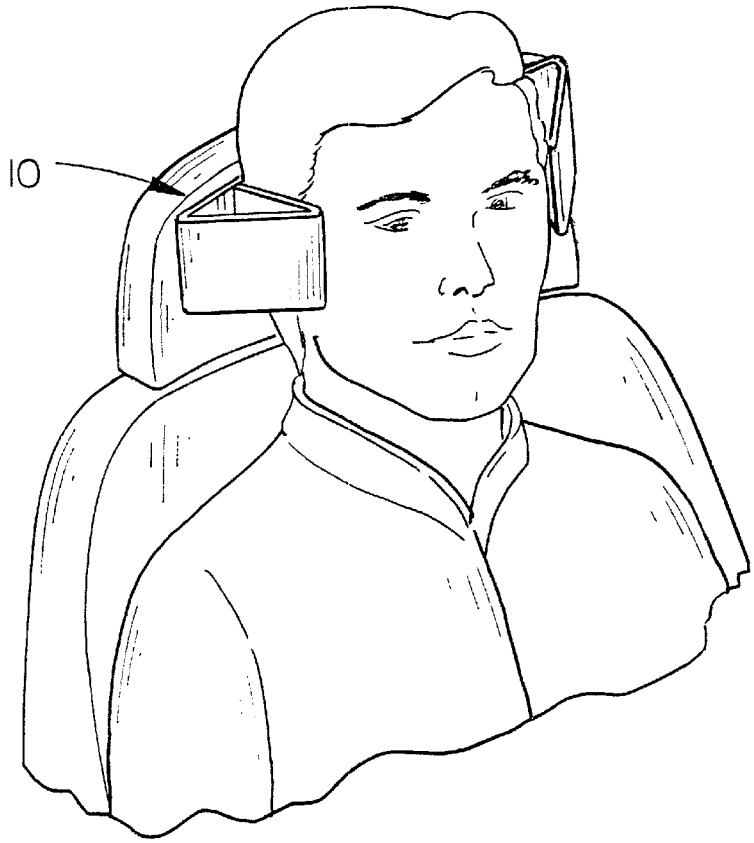
FIG. 1 is a perspective view illustrating a person using the head and neck rest of this invention.
Figure 2:
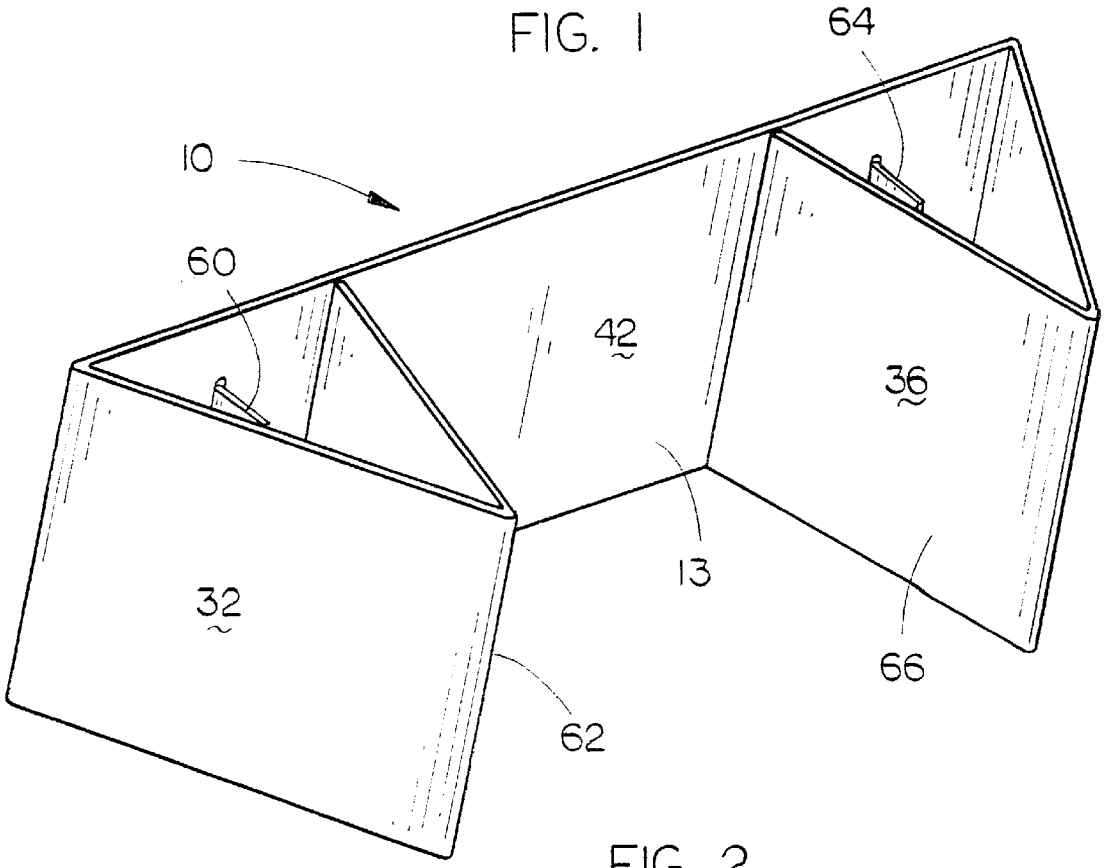
FIG. 2 is a perspective view of the head and neck rest of this invention.

The head and neck rest of this invention is referred to generally by the reference numeral 10 and is formed from a generally rectangular member 12 preferably constructed from cardboard, paper, plastic or other suitable material. In the preferred embodiment, the rectangular member 12 is constructed from a cardboard material.

Rectangular member 12 will be generally described as including a front surface 13 and rear surface 15. Further, rectangular member 12 includes a top edge 14, bottom edge 16, and opposite ends 18 and 20. Tabs 22 and 24 extend outwardly from ends 18 and 20, respectively.

A first fold line 26 is formed in member 12 inwardly of end 18 to define a first flap portion 28. A second fold line 30 is formed in member 12 inwardly of fold line 26 to define a second flap portion 32. A third fold line 34 is formed in member 12 inwardly of end 20 to define a third flap portion 36. A fourth fold line 38 is formed in member 12 to define a fourth flap portion 40. For purposes of description, fold lines 30 and 38 define a base portion 42 therebetween. Fold lines 44 and 46 are formed in tab 22 while fold lines 48 and 50 are formed in tab 24.

Figure 3:
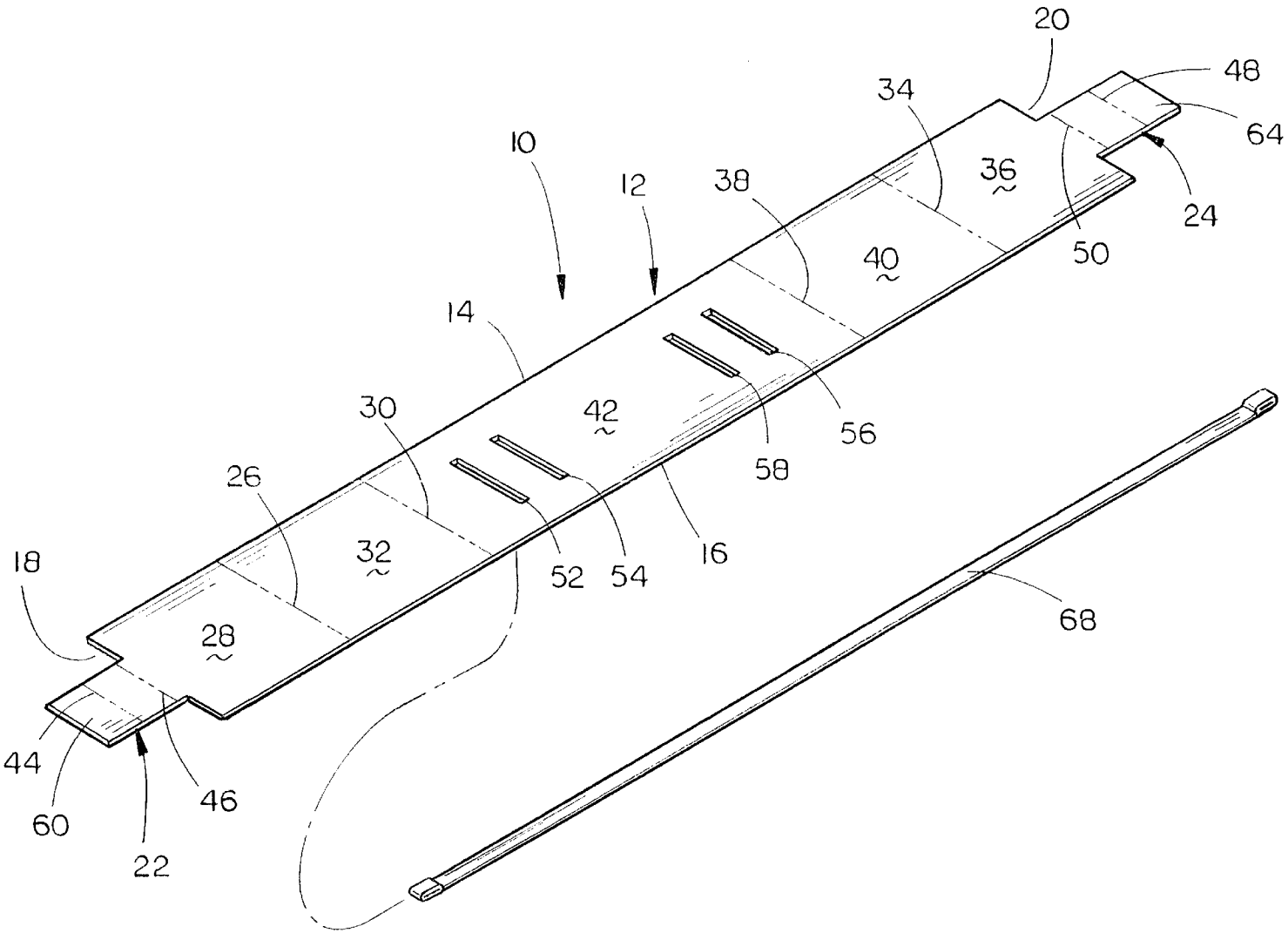
FIG. 3 is a perspective view illustrating the head and neck rest prior to it being folded to its operative position.
Figure 4:
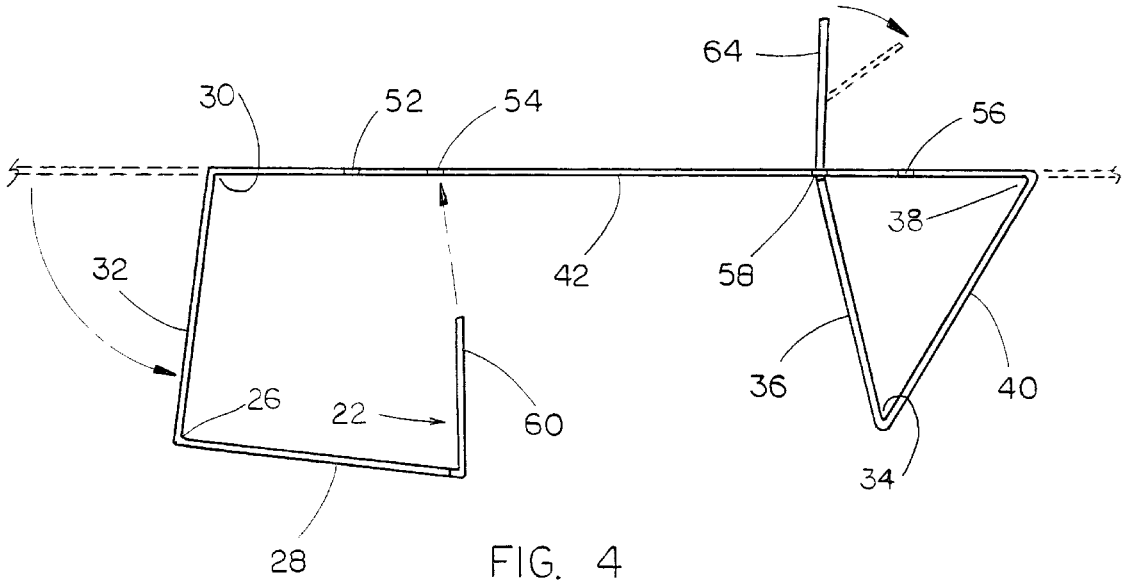
FIG. 4 is a top view of the head and neck rest illustrating the manner in which it is being folded.

A pair of vertically disposed and horizontally spaced-apart slots 52 and 54 are formed in base portion 42 inwardly of fold line 30, as seen in FIG. 3. A pair of vertically disposed and horizontally spaced-apart slots 56 and 58 are formed in base portion 42 inwardly of fold line 38, as seen in FIG. 3.

Figure 8:
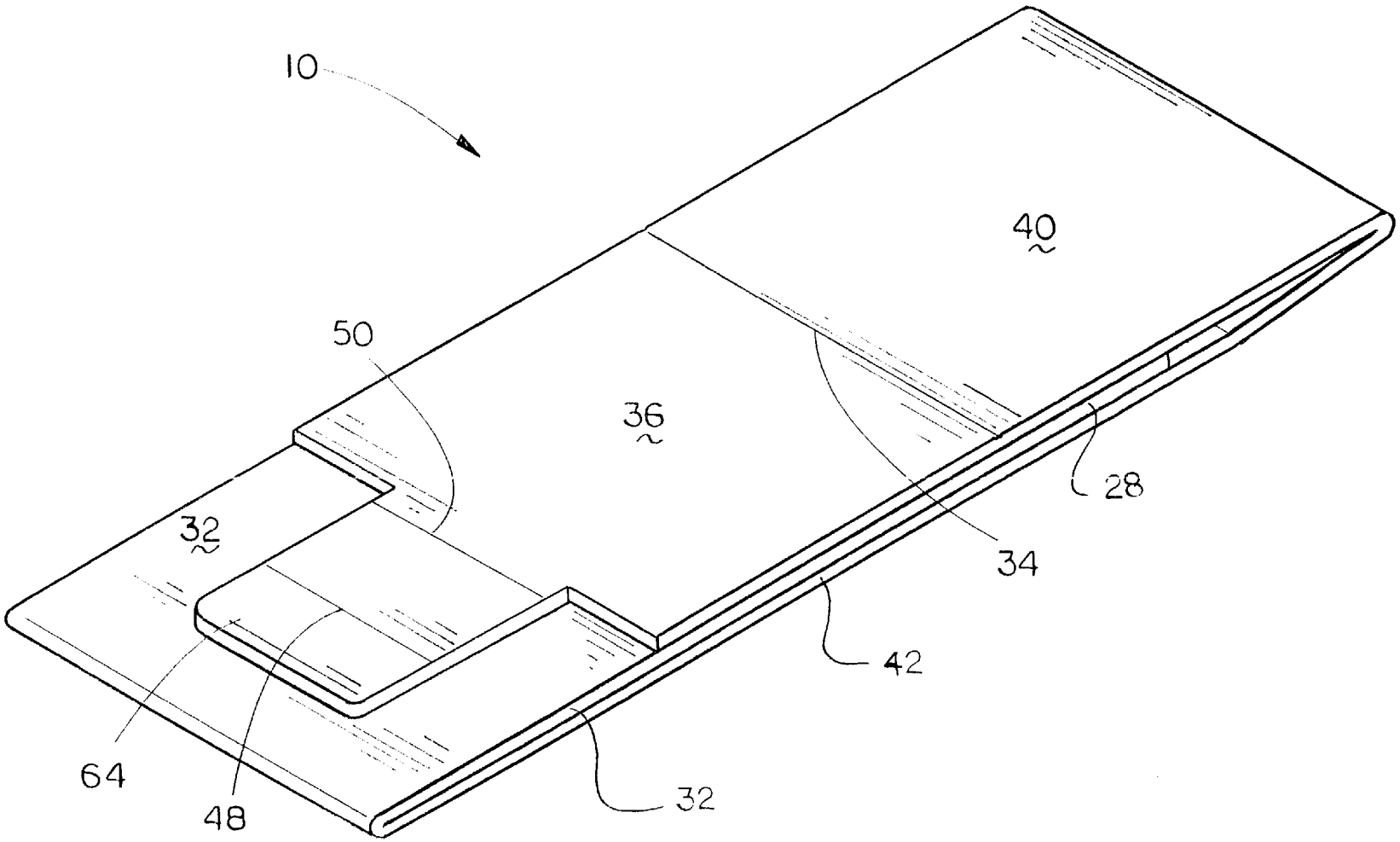
FIG. 8 is a perspective view illustrating the head and neck rest in its lowered position.

It is contemplated that the head and neck rest of this invention will be sold or distributed to the users in the flat condition illustrated in FIG. 8 so that it may be easily stored and transported. Normally, the flap portions 28 and 32 would be transported in a position wherein the flap portions 28 and 32 are positioned against base portion 42. Similarly, it is contemplated that flap portions 36 and 40 would be folded adjacent the folded flap portions 28 and 32 to enable the head and neck rest to be easily stored and transported. It is also contemplated that if a travel agency or the like is distributing the head and neck rest, suitable advertising materials would be imprinted on the head and neck rest.

Figure 5:
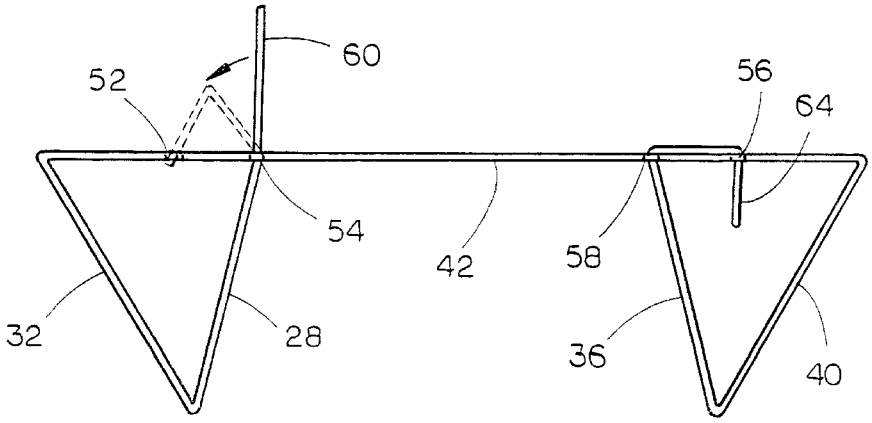
FIG. 5 is a view similar to FIG. 4 which further illustrates the head and neck rest being folded.
Figure 6:
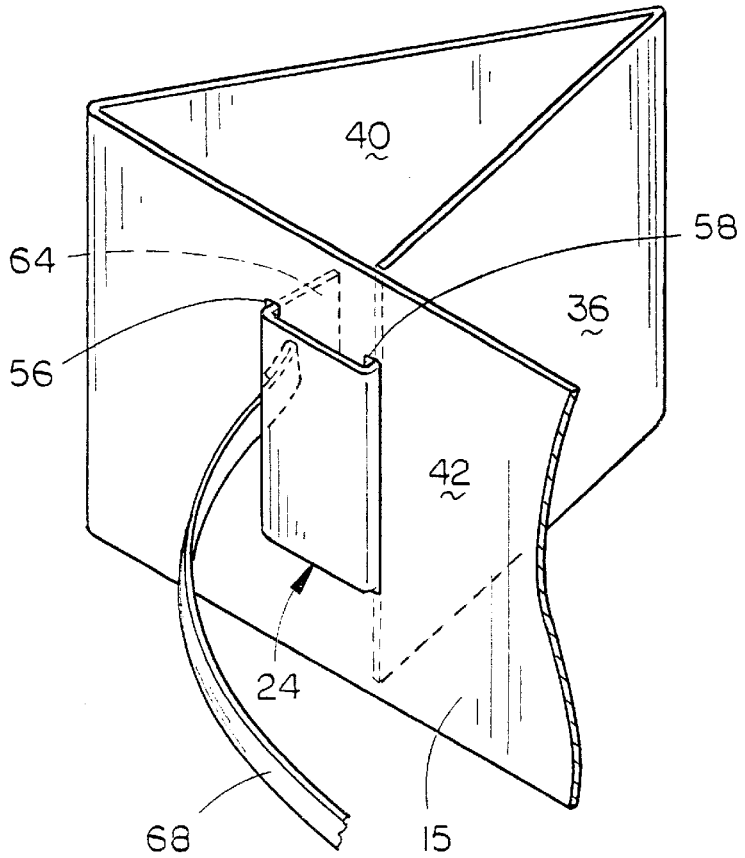
FIG. 6 is a partial rear perspective view of the head and neck rest.
Figure 7:
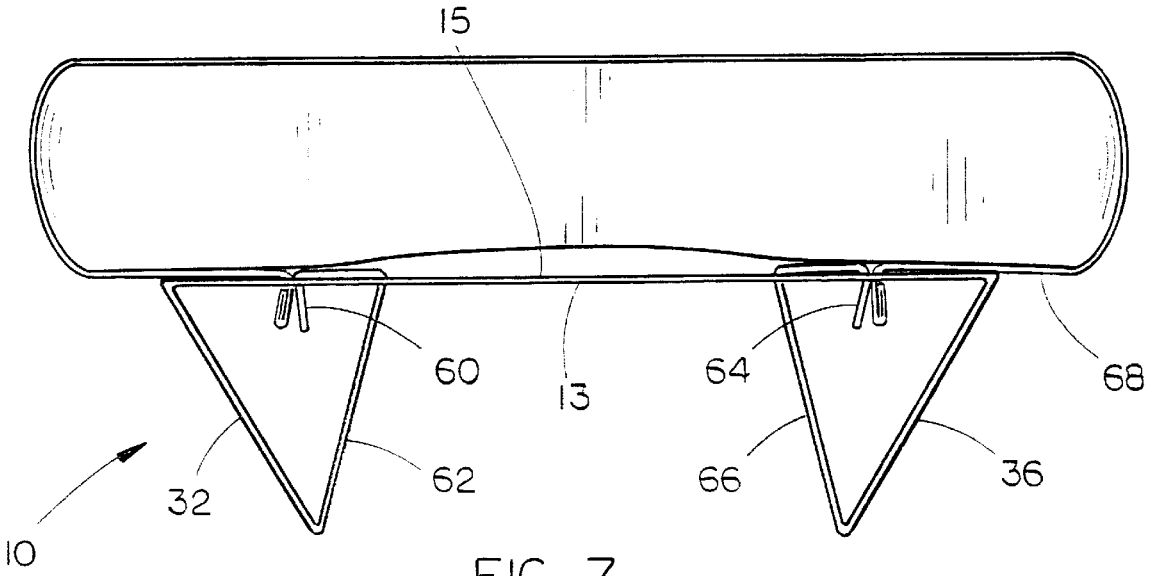
FIG. 7 is a top view of the head and neck rest mounted on a seat back.

Assuming that the head and neck rest is in the completely flat position illustrated in FIG. 3, the head and neck rest is formed as follows. Flap portion 32 is folded forwardly along fold line 30 and flap portion 28 is folded inwardly and rearwardly along fold line 26 so that tab 22 may be inserted through slot 54. Tab 22 is then folded along fold lines 44 and 46 so that the end portion 60 of tab 22 may be inserted through slot 52 from the back side of the head and neck rest, as illustrated by broken lines in FIG. 5. When the flap portions 28 and 32 have been folded as described, a triangular-shaped neck support 62 is created. It is important to note that when the triangular-shaped neck support 62 is formed, flap portion 28 extends inwardly and forwardly from base portion 42 and acts as a brace for the neck support 62.

Flap portion 40 is then folded forwardly with respect to base portion 42 along fold line 38 and flap portion 36 is folded inwardly and rearwardly with respect to flap portion 40 so that tab 24 may be inserted through slot 58. Tab 24 is then folded along fold lines 48 and 50 so that the end portion 64 of tab 24 may be extended forwardly through the slot 56 from the rearward side of the head and neck rest. When the flap portions 36 and 40 have been folded as described, a triangular-shaped neck support 66 is provided with the flap portion 40 serving as a brace for the support.

When the head and neck rest has been folded as just described, the head and neck rest may be positioned behind the user's head with the user's neck and/or head being positioned adjacent the front surface of base portion 42 and with the triangular-shaped neck supports 62 and 66 being positioned on opposite sides of the user's head and/or neck. The user may cause the supports 62 and 66 to more closely embrace his/her neck by increasing the rearward pressure against base portion 42. If desired, an elongated elastic member 68 may be utilized to secure the head and neck rest of this invention to the upper portion of a seat to maintain the same in position. When the elastic member 68 is utilized, one end thereof is inserted forwardly through the slot 52 and the other end of the elastic member 68 is inserted forwardly through the slot 56, as illustrated in the drawings.

Thus it can be seen that a novel disposable head and neck rest has been provided which is inexpensive to manufacture, easy to use and which may thrown away after use.

Accordingly, it can be seen that the invention accomplishes at least all of its stated objectives.

I claim:

1. A foldable head and neck rest, comprising:

a generally rectangular member having a forward side, a rearward side, a top edge, a bottom edge, and first and second ends;

said rectangular member having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive the user's neck and/or head therebetween; and means for maintaining said first, second, third and fourth flap portions in their said folded positions;

said base portion has first and second slots formed therein inwardly of said second fold line;

said base portion having third and fourth slots formed therein inwardly of said fourth fold line;

a first tab extending from said first end of said rectangular member;

a second tab extending from said second end of said rectangular member;

said first tab being received by said first and second slots when said first and second flap portions have been folded to form said first triangular-shaped support and to maintain said first and second flap portions in their said folded position;

said second tab being received by said third and fourth slots when said third and fourth flap portions have been folded to form said second triangular-shaped support and to maintain said third and fourth flap portions in their said folded positions.

2. The head and neck rest of claim 1 wherein said first and third flap portions extend forwardly and inwardly with respect to said base portion when said flap portions have been folded to form said triangular-shaped supports.

3. A foldable head and neck rest, comprising:

a generally rectangular member having a forward side, a rearward side, a top edge, a bottom edge, and first and second ends;

said rectangular member having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive the user's neck and/or head therebetween; and means for maintaining said first, second, third and fourth flap portions in their said folded positions;

said base portion has first and second slots formed therein inwardly of said second fold line;

said base portion having third and fourth slots formed therein inwardly of said fourth fold line;

said base portion further having an elongated elastic member secured thereto for selectively securing the head and neck rest to a seat;

a first tab extending from said first end of said rectangular member;

a second tab extending from said second end of said rectangular member;

said first tab being received by said first and second slots when said first and second flap portions have been folded to form said first triangular-shaped support and to maintain said first and second flap portions in their said folded position;

said second tab being received by said third and fourth slots when said third and fourth flap portions have been folded to form said second triangular-shaped support and to maintain said third and fourth flap portions in their said folded positions.

4. A foldable head and neck rest, comprising:

a generally rectangular member comprised of a paper material and having a forward side, a rearward side, a top edge, a bottom edge, and first and second ends;

said rectangular member having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion:, said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive the user's neck and/or head therebetween; and means for maintaining said first, second, third and fourth flap portions in their said folded positions;

said base portion has first and second slots formed therein inwardly of said second fold line;

said base portion having third and fourth slots formed therein inwardly of said fourth fold line;

a first tab extending from said first end of said rectangular member;

a second tab extending from said second end of said rectangular member;

said first tab being received by said first and second slots when said first and second flap portions have been folded to form said first triangular-shaped support and to maintain said first and second flap portions in their said folded position;

said second tab being received by said third and fourth slots when said third and fourth flap portions have been folded to form said second triangular-shaped support and to maintain said third and fourth flap portions in their said folded positions.

5. A foldable head and neck rest, comprising:

a generally rectangular member comprised of a cardboard material and having a forward side, a rearward side, a top edge, a bottom edge, and first and second ends;

said rectangular member having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive the user's neck and/or head therebetween; and means for maintaining said first, second, third and fourth flap portions in their said folded positions;

said base portion has first and second slots formed therein inwardly of said second fold line;

said base portion having third and fourth slots formed therein inwardly of said fourth fold line;

a first tab extending from said first end of said rectangular member;

a second tab extending from said second end of said rectangular member;

said first tab being received by said first and second slots when said first and second flap portions have been folded to form said first triangular-shaped support and to maintain said first and second flap portions in their said folded position;

said second tab being received by said third and fourth slots when said third and fourth flap portions have been folded to form said second triangular-shaped support and to maintain said third and fourth flap portions in their said folded positions.

6. A foldable head and neck rest, comprising:

a generally rectangular member comprised of a plastic material and having a forward side, a rearward side, a top edge, a bottom edge, and first and second ends;

said rectangular member having first, second, third and fourth fold lines formed therein;

said first fold line extending between said top and bottom edges of said rectangular member inwardly of said first end thereof to define a first flap portion;

said second fold line extending between said top and bottom edges of said rectangular member inwardly of said first fold line to define a second flap portion;

said third fold line extending between said top and bottom edges of said rectangular member inwardly of said second end thereof to define a third flap portion;

said fourth fold line extending between said top and bottom edges of said rectangular member inwardly of said third fold line to define a fourth flap portion;

said second and fourth fold lines defining a base portion therebetween;

said first and second flap portions being foldable along said first and second fold lines to form a first triangular-shaped support;

said third and fourth flap portions being foldable along said third and fourth fold lines to form a second triangular-shaped support;

said first and second triangular-shaped supports being spaced-apart to provide an area to receive the user's neck and/or head therebetween; and means for maintaining said first, second, third and fourth flap portions in their said folded positions;

said base portion has first and second slots formed therein inwardly of said second fold line;

said base portion having third and fourth slots formed therein inwardly of said fourth fold line;

a first tab extending from said first end of said rectangular member;

a second tab extending from said second end of said rectangular member;

said first tab being received by said first and second slots when said first and second flap portions have been folded to form said first triangular-shaped support and to maintain said first and second flap portions in their said folded position;

said second tab being received by said third and fourth slots when said third and fourth flap portions have been folded to form said second triangular-shaped support and to maintain said third and fourth flap portions in their said folded positions.

* * * * *